US010250993B1

(12) United States Patent
Xiao et al.

(10) Patent No.: US 10,250,993 B1
(45) Date of Patent: Apr. 2, 2019

(54) MINIATURE SPEAKER

(71) Applicant: AAC Technologies Pte. Ltd., Singapore (SG)

(72) Inventors: Bo Xiao, Shenzhen (CN); Guohui Chen, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/055,070

(22) Filed: Aug. 4, 2018

(30) Foreign Application Priority Data

Nov. 27, 2017 (CN) ..... 2017 2 1622927

(51) Int. Cl.

| | |
|---|---|
| ***H04R 9/00*** | (2006.01) |
| ***H04R 9/06*** | (2006.01) |
| ***H04R 9/02*** | (2006.01) |
| ***H04R 9/04*** | (2006.01) |
| ***H04R 1/02*** | (2006.01) |

(52) U.S. Cl.
CPC ..... *H04R 9/06* (2013.01); *H04R 1/02* (2013.01); *H04R 9/025* (2013.01); *H04R 9/043* (2013.01); *H04R 9/045* (2013.01); *H04R 9/046* (2013.01); *H04R 2307/204* (2013.01); *H04R 2400/11* (2013.01); *H04R 2499/11* (2013.01)

(58) Field of Classification Search
CPC ..... H04R 9/043; H04R 1/06; H04R 31/006; H04R 7/16; H04R 7/20; H04R 2231/003; H04R 2307/204; H04R 2307/207
See application file for complete search history.

(56) References Cited

U.S. PATENT DOCUMENTS

2010/0046788 A1* 2/2010 Harris ..... H04R 9/043 381/404
2010/0172535 A1* 7/2010 Huang ..... H04R 7/20 381/404

* cited by examiner

*Primary Examiner* — Matthew A Eason
(74) *Attorney, Agent, or Firm* — Na Xu; IPro, PLLC

(57) ABSTRACT

The present application discloses a miniature speaker. The miniature speaker includes a vibration system including a diaphragm, a voice coil for driving the diaphragm, and a suspension connected to the voice coil; a magnetic circuit system interacting with the voice coil for driving the diaphragm to radiate sound waves; and a frame for accommodating the vibration system and the magnetic circuit system. The suspension includes an outer edge connecting to the frame, an inner edge engaging with the voice coil, and a plurality of spring arms connecting the outer edge to the inner edge. The suspension includes a first isolative layer, a second isolative layer, and a conductive layer. The first isolative layer forms a mounting surface out of which at least part of the conductive layer exposes for connecting to the voice coil.

8 Claims, 3 Drawing Sheets

MINIATURE SPEAKER

FIELD OF THE PRESENT DISCLOSURE

This disclosure related to the field of electro-acoustic transducers, and more particularly to a miniature speaker used in a portable electronic device, like a mobile phone.

DESCRIPTION OF RELATED ART

A mobile phone is more and more popular in day life. As one important feature of a mobile phone, music play-back is one of the concerns for a user to choose a phone. A speaker is a component, or a transducer to convert electrical signals to audible sounds (music).

FPC, flexible printed circuit, is more and more popular to be used in a speaker because of the thickness and good conductive performance. Generally, the FPC is used to replace traditional suspension. A related suspension made by an FPC is typically formed by conductive layer embedded in isolative material, and the voice coil is connected to the isolative material. Due to the poor surface energy of the isolative material, the engagement between the voice coil and the suspension is not stable, and the voice coil is easy to be separated from the suspension. As a result, acoustic performance of the speaker is accordingly lowered.

Therefore it is necessary to provide an improved miniature speaker for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
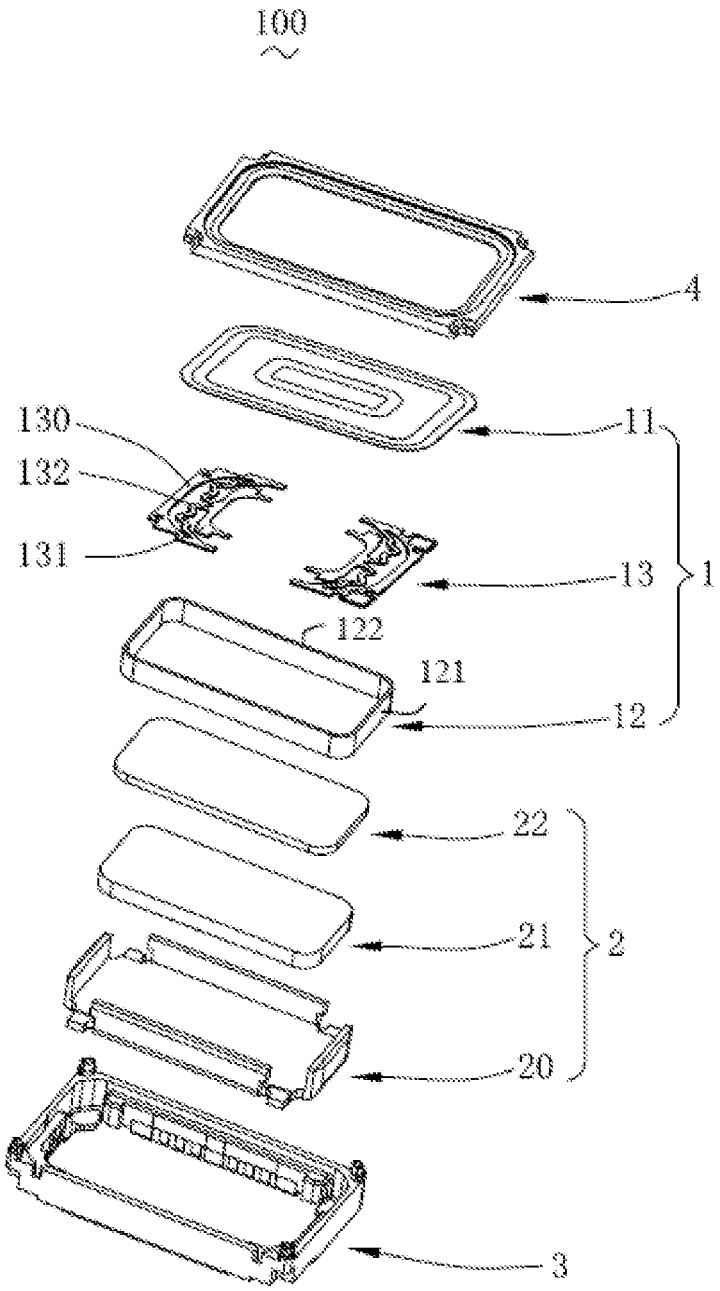
FIG. 1 is an isometric and exploded view of a miniature speaker in accordance with an exemplary embodiment of the present invention.

Referring to FIG. 1, a miniature speaker 100 in accordance with an exemplary embodiment of the present invention includes a vibration system 1, a magnetic circuit system 2, a frame 3 and a front cover 4. The vibration system 1 includes a diaphragm 11, a voice coil 12 for driving the diaphragm 11 to vibrate, and a suspension 13 engaged with the voice coil 12. The suspension 13 is disposed between the diaphragm 11 and the voice coil 12. In this embodiment, the amount of the suspensions 13 is two, and the two suspensions 13 are symmetrically located for connecting the voice coil 12 to the diaphragm 11. In an alternative embodiment, the suspensions 13 could be connected to an end of the voice coil away from the diaphragm 11.

The magnetic circuit system 2 includes a magnetic plate 20, a magnet 21 located on the magnetic plate 20, and a pole plate 22 attached to the magnet 21. A magnetic gap is formed between the magnet 21 and the magnetic plate 20. In an alternative embodiment, the magnetic circuit system 2 comprises two magnetic conduction parts one of which is a permanent magnet. The magnetic gap is formed between the two magnetic conductive parts.

The frame 3 engages with the front cover 4 for forming an accommodation space for receiving the magnetic system 2 and the vibration system 1. As shown in FIG. 1, the voice coil 12 includes two first arms 121 spaced apart from and opposite to each other, and a second arm 122 connecting with the two first arms 121, the first arms 121 and the second arm 122 forming a loop, and there is a one-to-one correspondence between the first arm 121 and the suspension 13. The two first arms 121 are parallel with each other, and the number of the second arm 122 is two, two second arms 122 are parallel with each other, with a length of the first arm is smaller with a length of the second arm.

Figure 2:
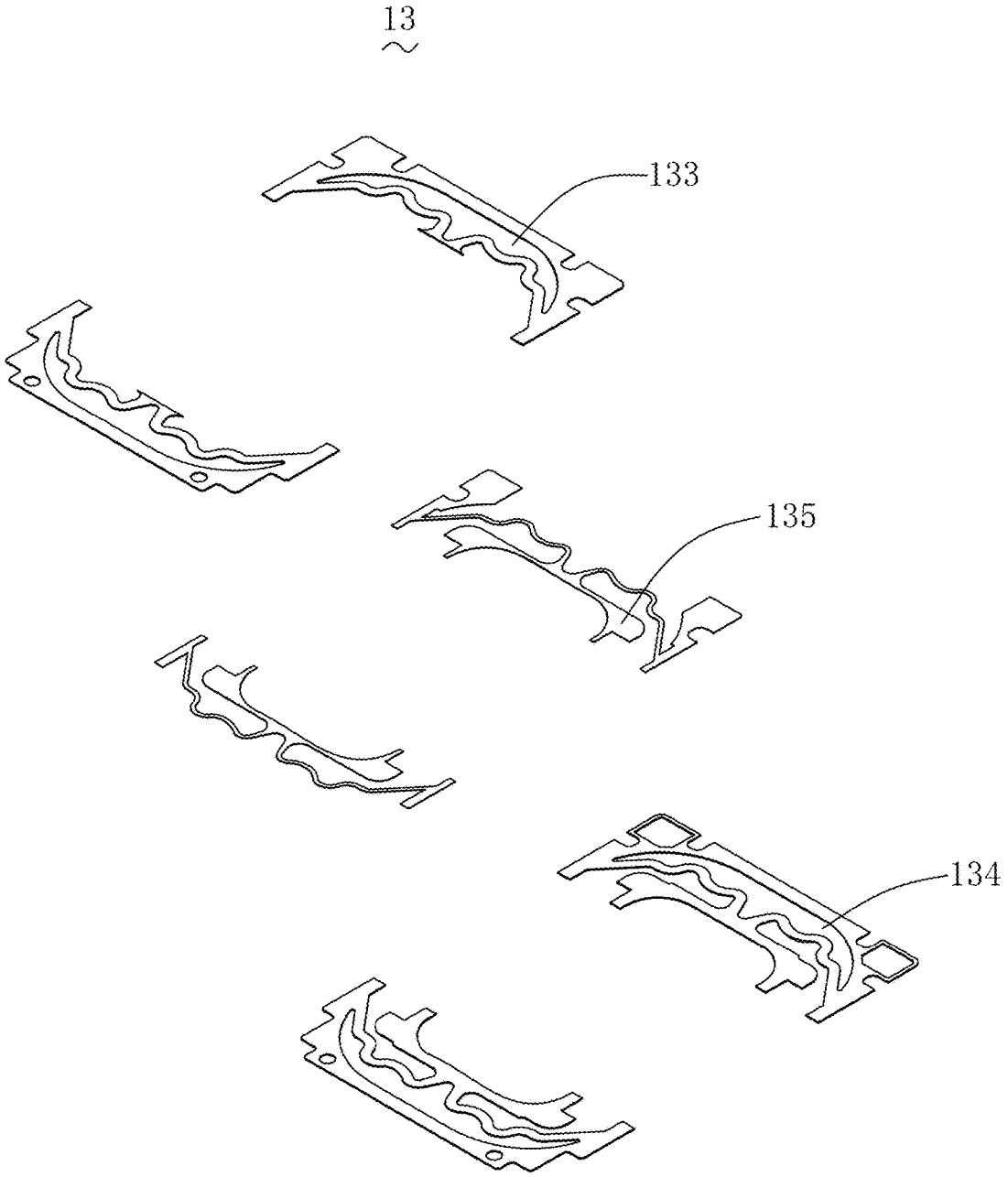
FIG. 2 is an isometric and exploded view of a suspension of the miniature speaker in FIG. 1.

Referring to FIG. 1 and FIG. 2, the suspension 13 includes an outer edge 130 connected to the frame 3, an inner edge 131 for mounting the voice coil 12, and at least one elastic arm 132 connecting the outer edge 130 to the inner edge 131. The suspension 13 includes a first isolative layer 133, a second isolative layer 134 spaced from the first isolative layer 133, and a conductive layer 135 sandwiched between the first and second isolative layers 133, 134. The first and second isolative layers 133, 134 are made from polyimide, and the conductive layer 135 is made from copper foil.

Figure 3:
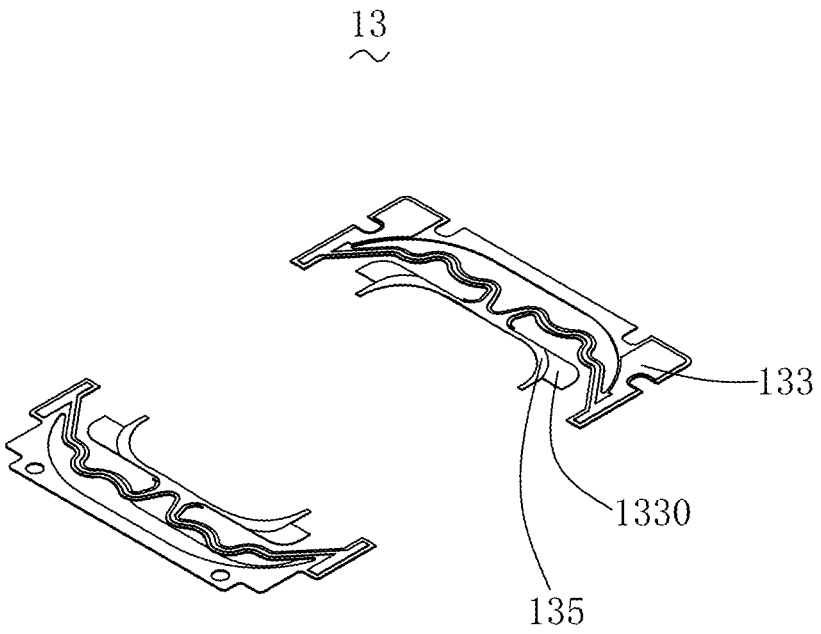
FIG. 3 is an assembled view of the suspension of the miniature speaker in FIG. 1.

Referring to FIG. 3, the inner edge 131 forms a mounting surface 1330, and the mounting surface 1330 is formed on the first isolative layer 133. The conductive layer 135 is at least partially disposed out of the mounting surface 1330 for electrically connecting with the voice coil 12 by soldering, adhesive, or other means. The voice coil 12 is connected to the suspension 13 by the engagement between the voice coil 12 and the conductive layer 135, which avoids the possible separation of the coil from the suspension 13 and improves the acoustic performance of the miniature speaker 100.

Compared with related technologies, the suspension 13 of the present invention includes an outer edge for connecting to the frame, an inner edge for connecting to the voice coil, and spring arms for connecting the inner edge to the outer edge. The suspension includes two isolative layers sandwiching a conductive layer therebetween. The conductive layer has a part disposed out of the isolative layer. Especially, the isolative layer comprises a mounting surface at the inner edge, and the conductive layer is partially disposed out of the mounting surface for electrically connecting to the voice coil. In related art, the voice coil is fixed to the isolative layer, and the lower surface energy will cause separation of the coil from the suspension. While in the present invention, the coil is connected to the conductive layer sandwiched between two isolative layers, which improves the stability of the engagement sue to higher or better surface energy.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature speaker, comprising:

a vibration system including a diaphragm, a voice coil for driving the diaphragm, and a suspension connected to the voice coil;

a magnetic circuit system interacting with the voice coil for driving the diaphragm to radiate sound waves;

a frame for accommodating the vibration system and the magnetic circuit system;

the suspension including an outer edge connecting to the frame, an inner edge engaging with the voice coil, and a plurality of spring arms connecting the outer edge to the inner edge;

wherein the suspension includes a first isolative layer, a second isolative layer opposite to the first isolative layer, and a conductive layer sandwiched between the first and second isolative layers, the first isolative layer forms a mounting surface out of which at least part of the conductive layer exposes for connecting to the voice coil;

the first isolative layer, the conductive layer and the second isolative layer are aligned with each other, with an area of the first isolative layer being less than an area of the second isolative layer to expose the at least part of the conductive layer.

2. The miniature speaker as described in claim 1, wherein the first and second isolative layers are made from polyimide.

3. The miniature speaker as described in claim 2, wherein the conductive layer is made from copper foil.

4. The miniature speaker as described in claim 1 including a pair of suspensions which are symmetrically disposed about the voice coil.

5. The miniature speaker as described in claim 1, wherein the voice coil electrically connected to an external circuit via the conductive layer of the suspension.

6. The miniature speaker as described in claim 1, wherein inner edge is arranged between the diaphragm and the voice coil, while the outer edge is disposed between the diaphragm and the frame.

7. The miniature speaker as described in claim 1, wherein the voice coil comprises: two first arms spaced apart from and opposite to each other, and a second arm connecting with the two first arms, the first arms and the second arm forming a loop, and there is a one-to-one correspondence between the first arm and the suspension.

8. The miniature speaker as described in claim 7, wherein the voice coil consists of two first arms and two second arms, the two first arms are parallel with each other and the two second arms are parallel with each other, with a length of the first arm is smaller with a length of the second arm.

* * * * *